US005835330A

United States Patent [19]

Kirschner et al.

[11] Patent Number: 5,835,330

[45] Date of Patent: Nov. 10, 1998

[54] METHOD AND DEVICE FOR DRIVING AN ELECTROMAGNETIC CONSUMER

[75] Inventors: Michael Kirschner, Ludwigsburg; Torsten Henke, Waiblingen, both of Germany

[73] Assignee: Robert Bosch GmbH, Stuttgart, Germany

[21] Appl. No.: 750,416

[22] PCT Filed: Jun. 6, 1995

[86] PCT No.: PCT/DE95/00731

§ 371 Date: Dec. 6, 1996

§ 102(e) Date: Dec. 6, 1996

[87] PCT Pub. No.: WO95/34754

PCT Pub. Date: Dec. 21, 1995

[30] Foreign Application Priority Data

Jun. 10, 1994 [DE] Germany ..... 44 20 282.2

[51] Int. Cl.[6] ..... H01F 7/18

[52] U.S. Cl. ..... 361/152; 361/154

[58] Field of Search ..... 361/152–156

[56] References Cited

U.S. PATENT DOCUMENTS

| | | | |
|---|---|---|---|
| 4,653,447 | 3/1987 | Linder et al. . | |
| 5,053,911 | 10/1991 | Kopec et al. | 361/154 |
| 5,539,608 | 7/1996 | Hurley et al. | 361/152 |

FOREIGN PATENT DOCUMENTS 34 26 799 7/1984 Germany .

*Primary Examiner*—Fritz Fleming
*Attorney, Agent, or Firm*—Kenyon & Kenyon

[57] ABSTRACT

A method and a device for driving an electromagnetic consumer (device) which includes a movable element, in particular a solenoid valve for metering fuel into an internal combustion engine. Within a timing window, a switching instant is determined by evaluating the time characteristic of a variable which corresponds to the current flowing through the electromagnetic consumer. A clocked voltage control is provided within the timing window.

11 Claims, 4 Drawing Sheets

METHOD AND DEVICE FOR DRIVING AN ELECTROMAGNETIC CONSUMER

FIELD OF THE INVENTION

The present invention relates to a method and a device for driving an electromagnetic consumer (device).

BACKGROUND INFORMATION

A method and a device for driving an electromagnetic consumer (device) are disclosed by the German Laid Open Print 34 26 799 (U.S. Pat. No. 4,653,447). It describes a device used for detecting the switching instants and, proceeding from this, the break times of the solenoid valve. The exact switching instant of the solenoid valve is determined on the basis of the time characteristic of the current flowing through the solenoid valve.

Furthermore, a device is disclosed by the German Laid Open Print 42 37 706 for detecting the switching instant of a solenoid valve. In this device, a clocked driving of the valve takes place. The current flowing through the valve is controlled to a set point value. The instant when the pulse duty factor changes is recognized as the switching instant.

Solenoid valves of this type are preferably used for controlling fuel injection in gasoline and/or diesel engines. For the precise metering of even the smallest injection quantities, that switching instant is of particular interest at which the armature of the current-carrying solenoid valve reaches one of its two end positions.

The procedure in known systems is to evaluate the current characteristic within a timing window, in which the switching instant usually occurs, and to determine the switching instant on the basis of its time characteristic. The voltage being applied to the solenoid valve is thereby adjusted to a specific value. Thus, a constant solenoid valve voltage is made available to produce a constant characteristic of the solenoid valve current. During this phase in which the voltage is regulated, those switching elements of the control device which are involved are operated at voltage levels at which considerable power losses sometimes occur, which can lead over the short term to an unwanted increase in the temperature of the switching element.

SUMMARY OF THE INVENTION

An object of the present invention is to provide an electromagnetic consumer (device) with reduced power loss (dissipation).

Because a clocked voltage control with a specified frequency and a specified pulse duty factor takes place within the BIP (beginning of injection period) timing window, the advantage is attained that the voltage control can be eliminated during BIP recognition, thus considerably reducing the outlay for components and providing for a simpler circuit.

During the BIP recognition phase, which can also be described as the BIP window, the operation of the switching element at levels at which power losses occur is considerably reduced. The characteristic current profile that is adjusting itself makes it possible, given different types of solenoid valves and after first determining the necessary pulse duty factor in each case, for the current characteristic to be reliably evaluated and, thus, for the switching instant to be precisely detected.

With respect to the hydraulic forces and their negative effects on the position of the armature, the possibility exists, by specifying the pulse duty factor, for the current level (force level) to be retained. This offers the advantage that the closing characteristics can be optimally conceived in the sense of available possibilities for intervention. It is not a costly task for a microcomputer or for separate hardware switching pattern, so that the circuit and its function can be simplified as far as realization outlay is concerned. Furthermore, the task of filtering the signal is eliminated.

DETAILED DESCRIPTION OF THE INVENTION

The present invention provides for driving an electromagnetic consumer (device). In principle, the device and method of the present invention can be applied in conjunction with any electromagnetic consumers. They are not limited to a special use. However, it is particularly advantageous to employ the device and method according to the present invention in conjunction with internal combustion engines, in particular in the metering of fuel into a combustion chamber of a self-ignition internal combustion engine. For this purpose, a solenoid valve is used quite advantageously for controlling the metering of fuel into the internal combustion engine.

It is necessary here, especially when working with small loads, for the smallest injection quantities to be metered as exactly as possible. This necessitates, in turn, knowing the instant when the armature of the current-carrying solenoid valve reaches its end position. This instant is usually described as beginning of injection period (BIP). It can be acquired by evaluating the time characteristic of the solenoid valve current.

Preferably, the time characteristic of the current given a constant voltage or the time characteristic of the voltage given a constant current are evaluated to determine whether there is a discontinuity (bend) in the characteristic or an important change in the difference quotient of the variable being considered. Such a device is disclosed, for example, by the German Laid Open Print 42 238 891.

Figure 1:
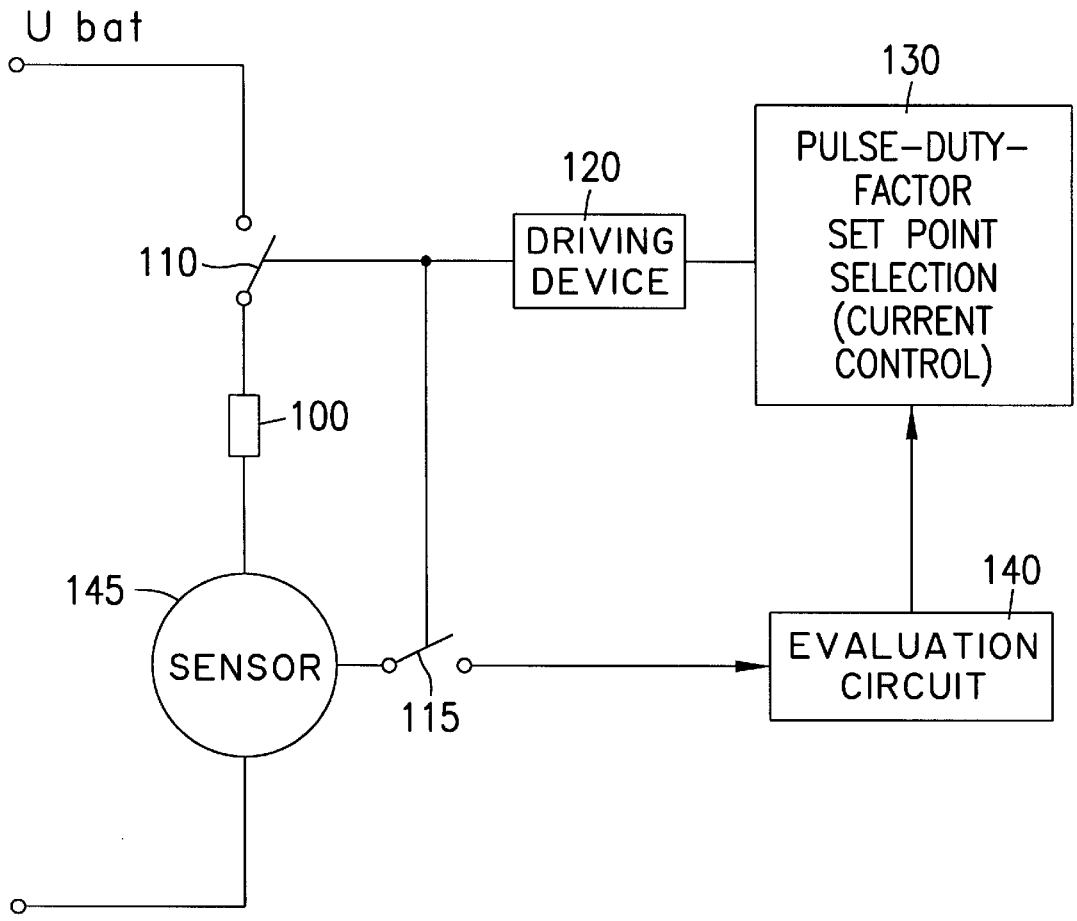
FIG. 1 shows a block diagram of the device according to the present invention.

In FIG. 1, essential elements of a device for controlling a solenoid-valve controlled fuel-metering device are shown schematically. An electromagnetic consumer 100 is connected via a switching element 110 to a voltage-supply device (Ubat). The switching element is triggered by a driving device 120. The driving device 120, in turn, can be linked to a current control or to a pulse-duty-factor set point selection 130.

The other connection of the electromagnetic consumer is connected via a sensor 145 or a current-detecting means to ground. Sensor 145 is linked via an evaluation circuit 140, and said evaluation circuit 140 to the voltage control or the current control 130 or to the driving device 120. Furthermore, the driving device 120 triggers another switching element 115, which is arranged between sensor 145 and evaluation circuit 140.

The components in the series circuit including switching element 110, consumer 100 and sensor 145 can be selected in any desired order.

As circuit components, preferably transistors, in particular, field-effect transistors are used.

Figure 2:
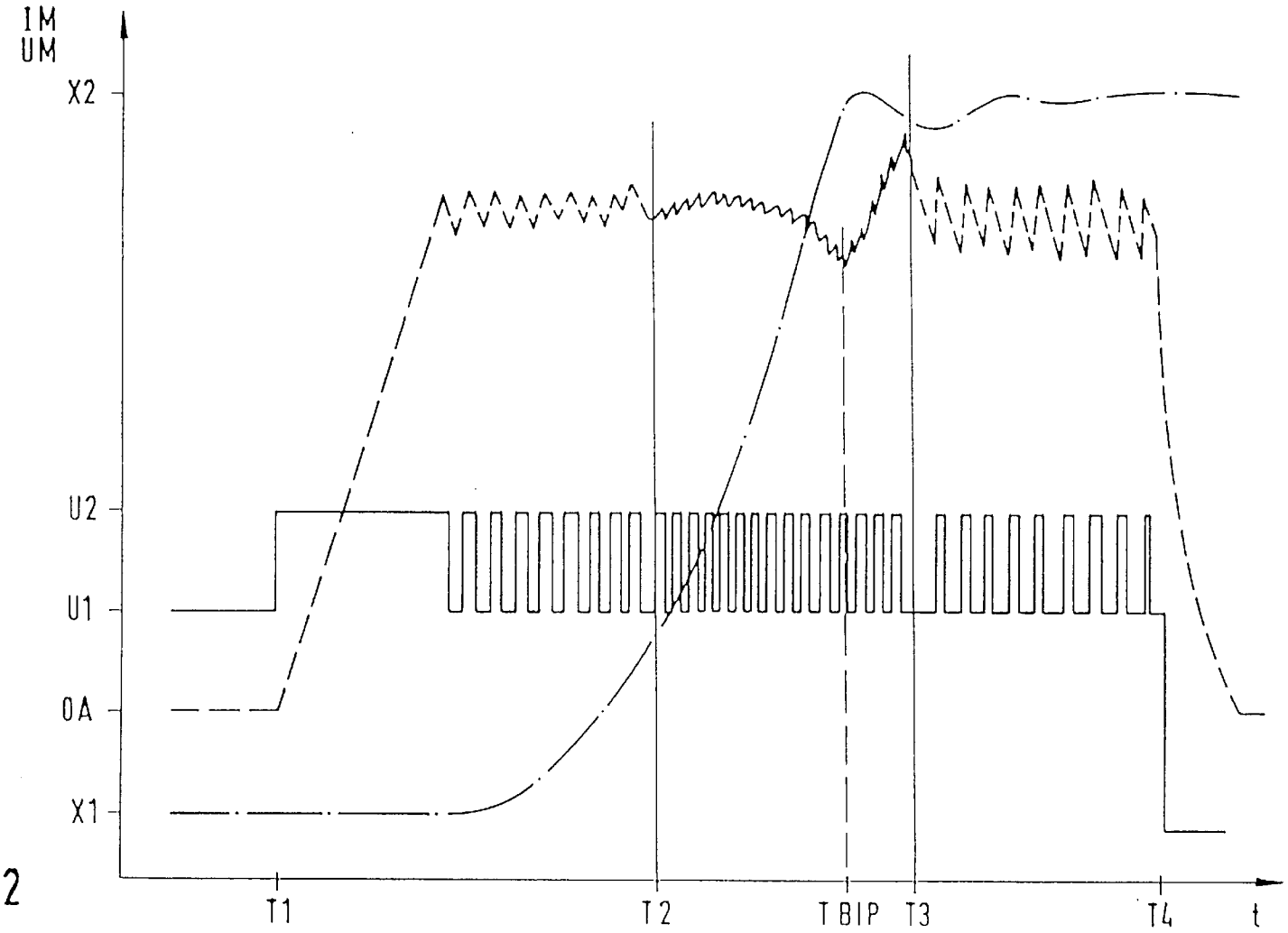
FIG. 2 shows signals according to the present invention plotted over time.

The method of operation of the device according to the present invention is described in the following on the basis of FIG. 2. In FIG. 2, the lift H of the solenoid valve needle or of the armature is drawn in with a dot-dash line, the voltage UM dropping across consumer 100 with a solid line, and the current IM flowing through consumer 100 with a dashed line.

These signal patterns are plotted in FIG. 2 over the time t. At the beginning, the armature of the solenoid valve is situated in its first end position X1. The current IM assumes the value 0 and the voltage UM dropping across the solenoid valve likewise assumes a first value U1.

At a specified instant T1, the driving device 120 triggers the switching element 110 in such a way that the voltage assumes a second value U2. This value lies within the range of the battery voltage Ubat. At the same time, the current IM rises over time. Initially, the armature of the solenoid valve does not show any reaction.

This state is retained until the current flowing through the solenoid valve reaches a specified threshold value. This threshold value lies within the range of a few ampere. If this threshold value is reached, then the current control 130 generates an appropriate signal and routes this signal to driving device 120. Driving device 120 triggers switching element 110 to open again. This, in turn, effects a drop in the current flowing through the solenoid valve. The current control 130 compares the current value detected by sensor 145 with a specified nominal value and, in dependence upon the result of the comparison, generates a signal to be received by the driving device 120. Through the opening and closing of switching element 110, the driving device 120 adjusts the current to the set point value.

In this exemplary embodiment, this set point value lies at about 10 ampere. In this period of time, the armature begins to move in the direction of its second end position X2.

Figure 3:
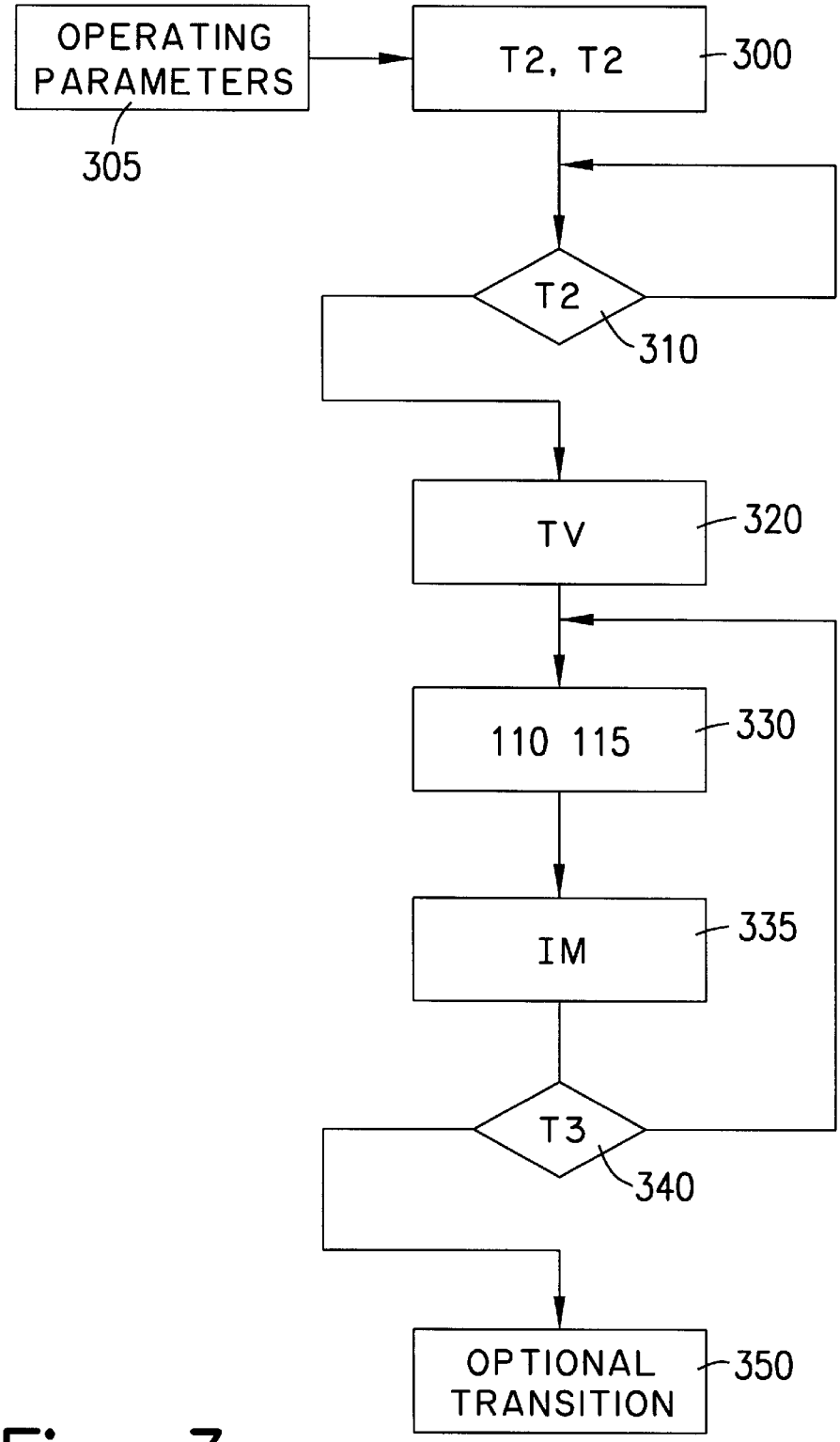
FIG. 3 shows a flow chart of an embodiment of the method according to the present invention.

The method according to the present invention is illustrated in FIG. 3 as a flow chart. In a first step, instants T2 and T3 are specified on the basis of various operating parameters 305. It is especially advantageous when values T2 and T3 are specified in dependence upon characteristic operating quantities, such as r.p.m., injected fuel quantity, or other quantities. This can be achieved, for example, by means of a characteristics map. Instants T2 and T3 define a timing window, within which the switching instant BIP probably occurs.

Query step 310 checks whether instant T2 is already reached. In known systems, the change is made to a voltage control at instant T2. This means that switching element 110 is operated through appropriate driving in the linear range of its characteristic curve, so that considerable power losses occur, as a result. The efficiency of the electronic injection system is diminished by this power loss (dissipation).

To increase the efficiency of the injection system and the thermal loading of the switching element 110, the procedure is as follows starting with the instant T2. Within the timing window, the transition is made to a clocked voltage control. For this purpose, a drive pulse pattern of a fixed frequency and with a fixed, but adjustable pulse duty factor is specified by the driving device 120 or by a higher-level microcomputer in step 320. This pulse duty factor is so selected that in conjunction with the nearly constant battery voltage, a constant voltage UMV, which is likewise nearly constant in its average value, is adjusted at the solenoid valve.

The frequency F or the period duration of the driving signal are selected so as to provide the evaluation circuit with enough time to perform the calculations.

In step 330, switching elements 110 and 115 receive the appropriate driving signal. In step 335, sensor 145 detects the current flowing through consumer 100.

The average value of the solenoid valve current IM has the same characteristic as when a constant voltage is applied. However, because of the clocked operating mode, the solenoid valve current oscillates about its average value. These fluctuations make it more difficult to evaluate the current characteristic produced in this manner.

To avoid a secondary filtering of the current characteristic, the current is evaluated in switch-controlled synchronism. This means the current is recorded in each case at fixed instants after the output stage is switched on and/or at fixed instants after the switching element 110 is switched off. These time-discrete current values are then supplied to the evaluation circuit 140. In the simplest specific embodiment, switch 110 and 115 are simultaneously triggered by the drive circuit 120.

In view of the fact that the time characteristic of the current between the switching on and off is substantially linear, the difference quotient of the time characteristic of the current can be simply calculated during the timing window from the sampled current values. Based on this determination of the difference quotients, the switching instants are calculated using known software evaluation methods.

In accordance with the present invention, the average value of the solenoid valve voltage is selected by stipulating a fixed pulse duty factor with a constant period duration T to generate a current characteristic that can be evaluated with respect to the BIP while doing without a voltage control.

In this embodiment, according to the present invention the average value of the current drops slowly from instant T2 on. Superposed on this drop are harmonic oscillations in integral multiples of the frequencies of the driving signal. The armature thereby continues its movement in the direction of its new end position X2.

While the armature moves, a voltage is induced in the coil of the electromagnetic consumer. At the switching instant TBIP, the armature reaches its new end position and completes its motion. This causes the induced voltage to disappear. As a result, the current IM flowing through the coil exhibits a different slope angle from this instant on. This change in the current characteristic is detected by means of evaluation circuit 140.

In this case it is not essential for the current to drop slowly. Depending on the embodiment, the current has a continuously differentiable characteristic on both sides of the instant TBIP. At the instant TBIP, the rise of the current plotted over time changes.

Query step 340 checks whether instant T3 is reached. If this is not the case, then the consumer is driven further in steps 330, and the current is recorded in step 335.

Figure 4:
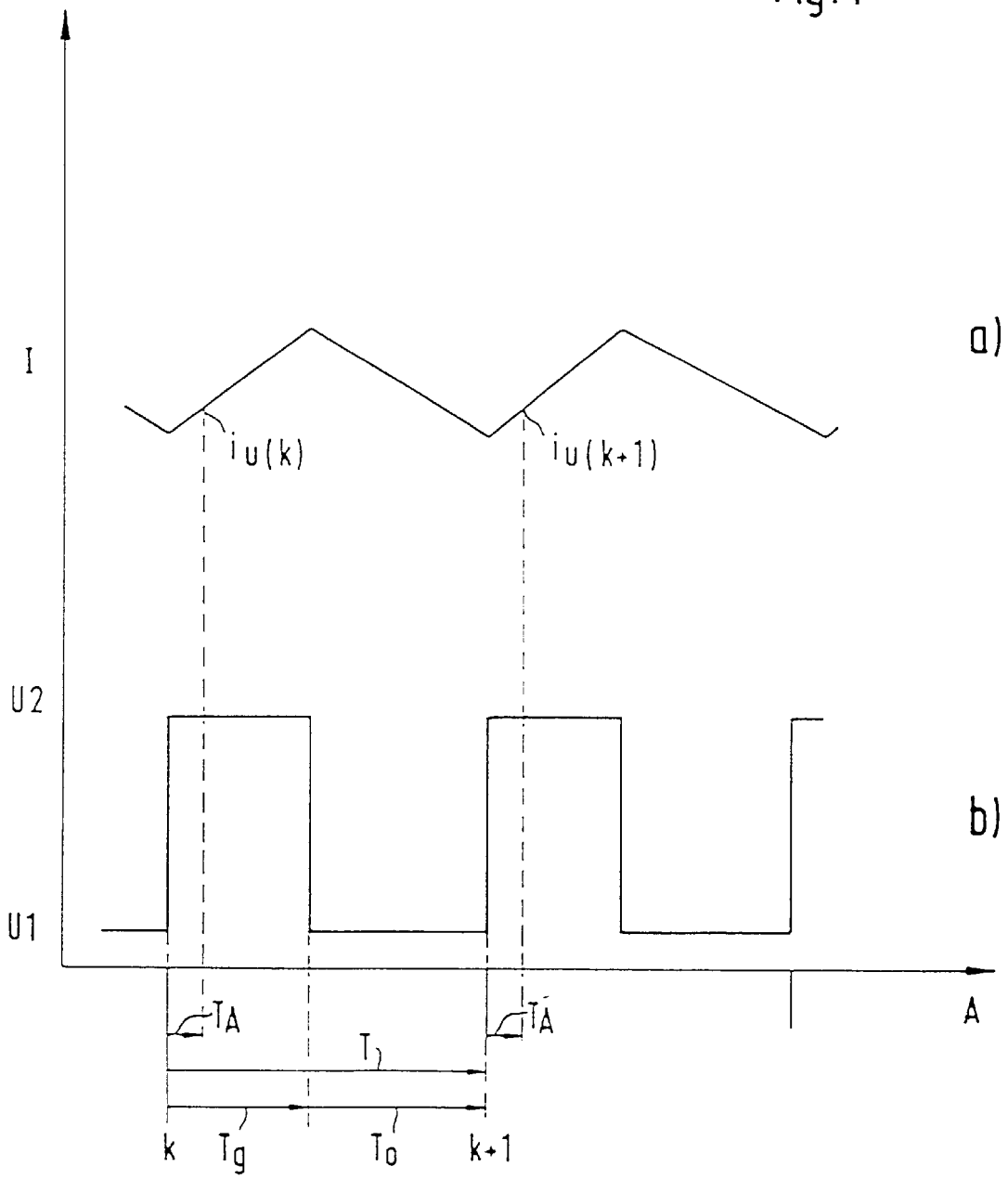
FIG. 4 shows a detail of one section of the signal graph of FIG. 2.

To elucidate different values, a portion of FIG. 2 is shown in greater detail in FIG. 4. Plotted over time t in the partial FIG. a is the current IM flowing through the consumer and, in partial FIG. b, the voltage UM. The period duration of the driving signal is denoted by T. $T_g$ describes the time duration in which the consumer is switched on. $T_o$ describes the time duration in which the consumer is switched off. $T_A$ describes the time when the measured value of the current is recorded.

To evaluate the current characteristic, the difference quotient of the current characteristic is usually needed during the BIP window.

The difference quotient can be simply calculated from the sampled current values. The current values are sampled at a fixed, specifiable instant $T_A$ following the switch-on (closing) operation, so that this calculation can preferably be performed in accordance with the following formula:

$$\Delta i/T = (i_{u(k+1)} - i_{u(k)})/T$$

The value $i_{u(k+1)}$ is the active sampling value for the current at the instant (k+1) and, in the case of the value $i_{u(k)}$, it is the sampling value for the current at the instant (k). The instant (k) lies in this case temporally before the instant (k+1). Alternatively, the current values can also be sampled at a fixed, specifiable instant $T_A$ following the switch-off (breaking) operation. In this case, a corresponding formula applies.

On the basis of this determination of the difference quotient, additional calculations can now follow with the help of known evaluation methods to determine the switching instant.

On the basis of the clocked driving in the BIP window, the power loss can be considerably reduced. Because of the time-synchronized sampling of the current values, the evaluation of the current characteristic is not adversely affected. To the contrary, the information required to recognize the switching instant can be obtained simply and with little outlay.

If the query step 340 recognizes that instant T3 is reached, then the transition is made optionally in step 350 to current control or, in the case that T3=T4, switch 110 is opened. At the instant T4, switch 110 is opened and the driving of the solenoid valve ends.

What is claimed is:

1. A method for driving an electromagnetic device having a movable element, comprising the steps of:

generating a driving signal, within a timing window, via a clocked voltage control having a predetermined frequency and a predetermined pulse duty factor, the predetermined frequency and the predetermined pulse duty factor being constant throughout the timing window;

controlling a current of the electromagnetic device as a function of the driving signal to provide a current control;

when the timing window is reached, switching from the current control to the clocked voltage control; and determining a switching instant of the movable element within the timing window by evaluating a time characteristic of a variable corresponding to the current flowing through the electromagnetic device.

2. The method for driving an electromagnetic device according to claim 1, wherein the movable element includes a solenoid valve for metering fuel into an internal combination engine.

3. The method for driving an electromagnetic device according to claim 1, wherein the determining step further includes evaluating discrete current values of the current flowing through the electromagnetic device.

4. The method for driving an electromagnetic device according to claim 3, wherein the drive signal is generated in a drive circuit and the current values are evaluated in synchronism with the drive circuit.

5. The method for driving an electromagnetic device according to claim 3, wherein the current values are sampled at a defined time following one of a switch-on operation and a switch-off operation of the electromagnetic device.

6. The method for driving an electromagnetic device according to claim 3, wherein a differential quotient Δi/T is calculated as a function of the current values in accordance with the formula $$\Delta i/T = (I_{u(k+1)} - I_{u(k)})/T,$$

the value $I_{u(k+1)}$ being a current value at the instant (k+1), the value $I_{u(k)}$ being a current value at the instant (k), and T being a period duration of the driving signal.

7. A device for driving an electromagnetic component including a movable element, comprising:

a first arrangement generating a drive signal, within a timing window, the first arrangement performing a clocked voltage control with a predetermined frequency and a predetermined pulse duty factor, the predetermined frequency and the predetermined pulse duty factor being constant throughout the timing window;

a second arrangement controlling a current of the electromagnetic device as a function of the drive signal to provide a current control; and a third arrangement determining a switching instant of the movable element within the timing window by evaluating a time characteristic of a variable corresponding to the current flowing through the electromagnetic device, wherein, when the timing window is reached, the third arrangement switches from the current control to the clocked voltage control.

8. The device for driving an electromagnetic component according to claim 7, wherein the movable element includes a solenoid valve for metering fuel into an internal combustion engine.

9. The device for driving an electromagnetic component according to claim 7, wherein the third arrangement evaluates discrete current values of the current flowing through the electromagnetic device and the current values are evaluated in synchronism with the first arrangement.

10. The device for driving an electromagnetic component according to claim 9, wherein the third arrangement samples the current values at a defined time following one of a switch-on operation and a switch-off operation of the electromagnetic device.

11. The device for driving an electromagnetic component according to claim 9, wherein the third arrangement calculates a differential quotient Δi/T as a function of the current values in accordance with the formula $$\Delta i/T = (I_{u(k+1)} - I_{u(k)})/T,$$

the value $I_{u(k+1)}$ being a current value at the instant (k+1), the value $I_{u(k)}$ being a current value at the instant (k), and T being a period duration of the driving signal.

* * * * *

UNITED STATES PATENT AND TRADEMARK OFFICE

CERTIFICATE OF CORRECTION

PATENT No. : 5,835,330

DATED : November 10, 1998

INVENTOR(S): Kirschner, Michael and Henke, Torsten

It is certified that error appears in the above-identified patent and that said Letters Patent is hereby corrected as shown below:

Column 2, line 3, after "hardware" insert --to prepare a suitable pulse duty factor with a constant--.

Signed and Sealed this

Third Day of August, 1999

*Attest:*

Q. TODD DICKINSON

*Attesting Officer*

*Acting Commissioner of Patents and Trademarks*